US005561956A

United States Patent [19]

Englekirk et al.

[11] Patent Number: 5,561,956

[45] Date of Patent: Oct. 8, 1996

[54] CONCRETE ELEMENTS AND CONNECTORS THEREFOR

[75] Inventors: Robert E. Englekirk, 1146 Tellem Dr., Pacific Palisades, Calif. 90272; Juergen L. Plaehn, San Diego, Calif.

[73] Assignee: Robert E. Englekirk, Pacific Palisades, Calif.

[21] Appl. No.: 146,538

[22] Filed: Nov. 1, 1993

[51] Int. Cl.[6] ..... F04C 5/08

[52] U.S. Cl. ..... 52/223.13; 52/223.1; 52/223.8; 52/259; 52/583.1; 411/383

[58] Field of Search ..... 52/250–253, 259, 52/295, 583.1, 587.1, 223.13, 223.11, 167 R, 223.1, 223.2, 223.8; 411/383, 389, 397, 403

[56] References Cited

U.S. PATENT DOCUMENTS

| | | | |
|---|---|---|---|
| 2,724,261 | 11/1955 | Rensaa | 52/259 X |
| 3,585,771 | 6/1971 | Pinniger | 52/251 |
| 3,621,626 | 11/1971 | Tylius | 52/223.13 |
| 3,838,547 | 10/1974 | Meisberger | 52/295 |
| 3,927,697 | 12/1975 | Yoshinaga et al. | 52/169.1 |
| 3,952,468 | 4/1976 | Soum | 52/223.13 |
| 4,111,327 | 9/1978 | Tanakiev | 52/223.2 X |
| 4,195,457 | 4/1980 | Kissling et al. | 52/223.2 |
| 4,209,868 | 7/1980 | Tada et al. | 52/167.4 X |
| 4,619,096 | 10/1986 | Lancelot, III | 52/730.2 X |
| 4,743,138 | 5/1988 | Goy | 411/389 X |
| 4,781,006 | 11/1988 | Haynes | 52/583.1 |
| 4,848,405 | 7/1989 | Albrecht | 411/383 X |
| 5,030,052 | 7/1991 | Anderson et al. | 411/383 |
| 5,035,009 | 7/1991 | Lapish | 52/565 X |
| 5,038,545 | 8/1991 | Hiendl | 52/295 X |
| 5,261,198 | 11/1993 | McMillan | 52/252 X |
| 5,289,626 | 3/1994 | Mochida et al. | 52/223.13 X |
| 5,305,573 | 4/1994 | Baumann | 52/223.8 X |
| 5,392,580 | 2/1995 | Baumann | 52/252 X |

*Primary Examiner*—Carl D. Friedman
*Assistant Examiner*—Winnie Yip
*Attorney, Agent, or Firm*—Marshall, O'Toole, Gerstein, Murray & Borun

[57] ABSTRACT

A first concrete element has a connecting member, and the connecting member of the first concrete element has a hole extending therethrough. A second concrete element has a connecting member, and the connecting member of the second concrete element has a threaded hole. A bolt is inserted through the hole of the connecting member of the first concrete element and is threadably secured into the threaded hole of the connecting member of the second concrete element so as to join the first and second concrete elements together. The connecting member of the second concrete member may be ductile so that earthquake energy may be dissipated in order to prevent significant structural damage in the presence of an earthquake.

32 Claims, 6 Drawing Sheets

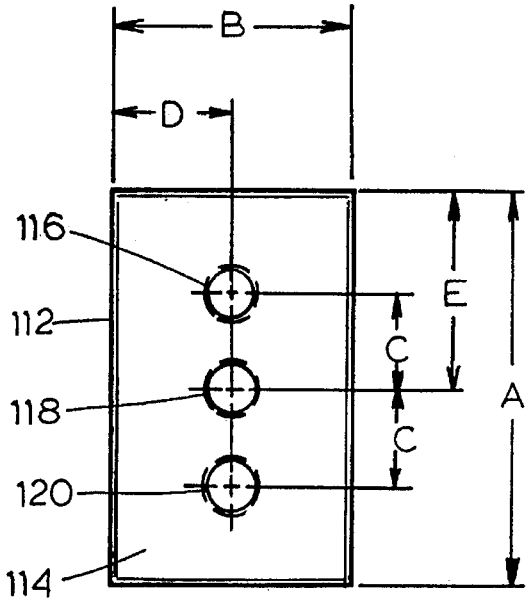
FIGURE 8
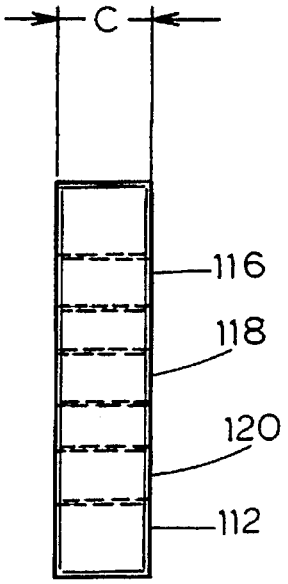
FIGURE 9
FIGURE 3
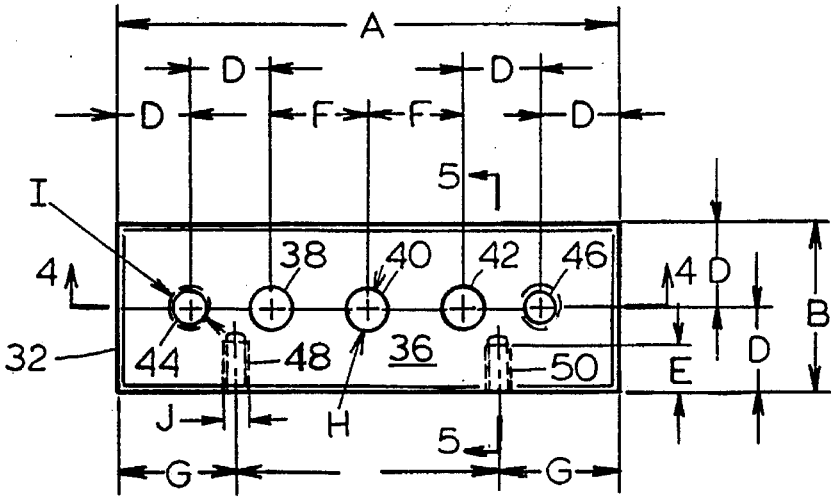
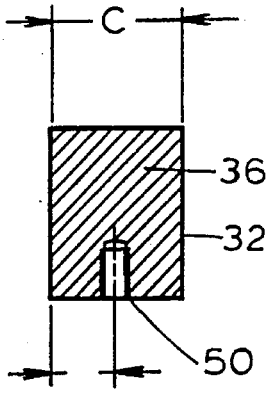
FIGURE 5
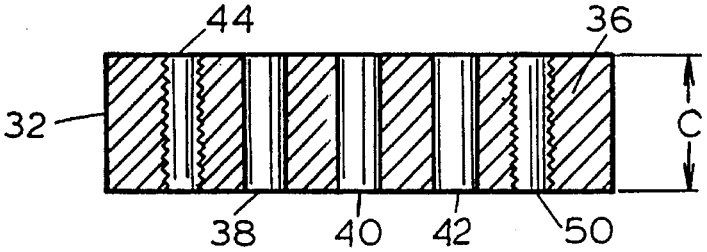
FIGURE 4

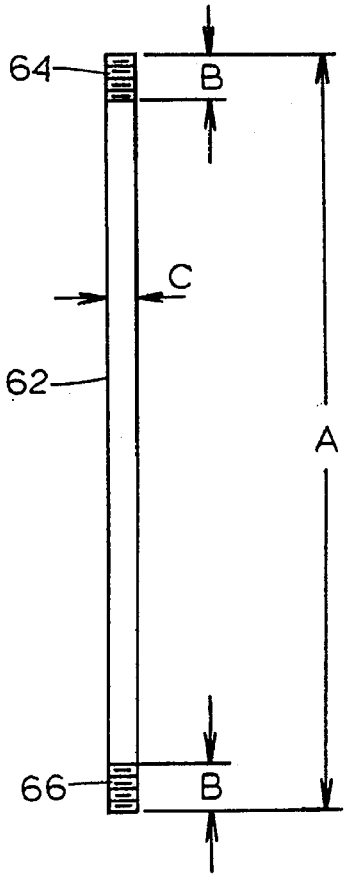
FIGURE 6
FIGURE 11
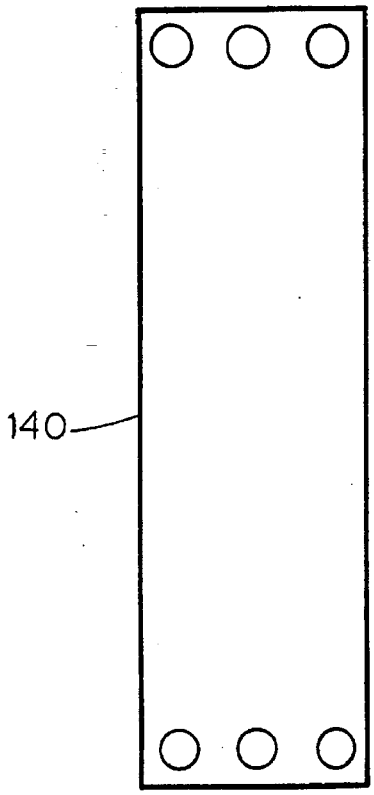
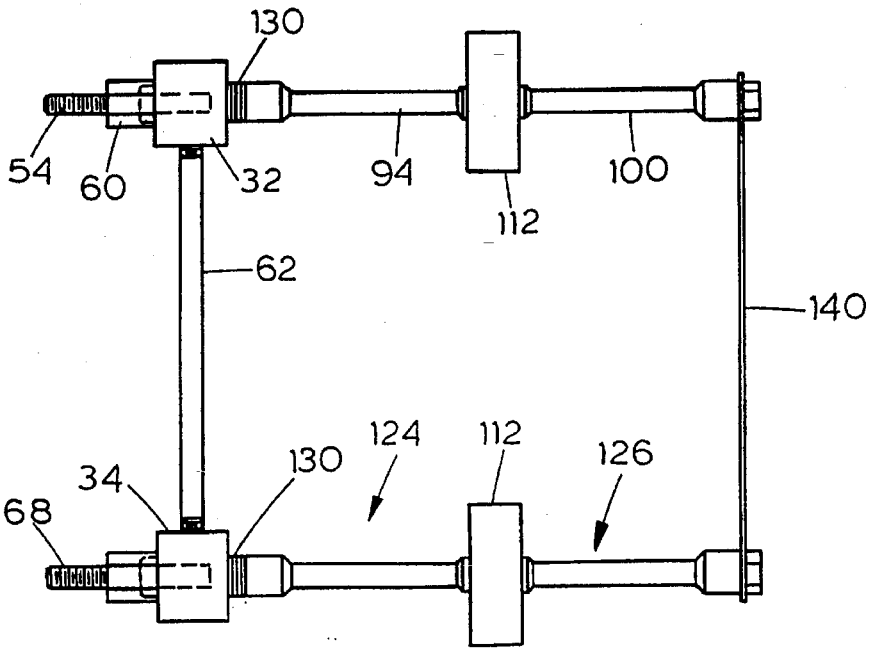
FIGURE 10

CONCRETE ELEMENTS AND CONNECTORS THEREFOR

TECHNICAL FIELD OF THE INVENTION

The present invention relates to concrete elements which are useful in the construction of buildings, and to connecting members for connecting concrete elements to one another.

BACKGROUND OF THE INVENTION

Currently, a wide variety of materials and construction techniques may be selected for the construction of single-story and multi-story buildings. For example, wood is often used for the framing of residential buildings; and, while wood may often be used during the construction of industrial, commercial, and institutional buildings, it is used primarily for temporary purposes and even then is often more costly than other materials. However, wood is not often suitable for the framing of industrial, commercial, and institutional buildings because wood is usually not strong enough to withstand the amount of load normally associated with industrial, commercial, and institutional buildings, and because wood is not particularly fire resistant.

Steel is often used as framing for industrial, commercial, and institutional buildings, particularly for long-span, single-story structures or for short span, single-story and multi-story buildings where either fireproof structures are not required or an adequate sprinkler system is provided. Unprotected steel begins to lose its strength at about 700° F. and, therefore, the steel used in steel frame construction may warp, twist and fail in the event of a serious fire in the building.

Where structures must be fireproofed, construction using reinforced concrete will generally be more economical, except where long spans are required, in which case steel framing, fireproofed with thin gunite or other light weight material, may be lower in cost. Reinforced concrete construction provides full fireproof construction. Also, the use of precast concrete elements, which may be cast off site or may be cast at the building site itself, reduces the amount of time and labor required to frame a building. Thus, precast concrete elements are used increasingly for such structural members as beams and columns, as well as for walls, floors, and roofs. These precast concrete elements are typically reinforced with steel rods, wire, or cable which may be prestressed or poststressed for additional strength.

The precasting of concrete elements, such as slabs, beams, columns, walls, and/or partitions, requires the construction of either metal or wood forms. The forms typically hold the reinforcing steel rods, wire, or cable in place while concrete is poured into the form. To reduce the number of connections (i.e., joints) between precast concrete elements, these elements should generally be cast as large as can be properly handled. However, some connections will be needed between precast concrete elements, and these connections must transfer moments, torsion, shear, and/or axial loads from one precast concrete element to another.

The integrity of a building erected by the use of precast concrete elements depends upon the adequacy of the design of the connections between the building's precast concrete elements. These connections may be made by the use of pins, clips, keys, welding, or by any number of other methods, and must withstand stresses due to a building's live and dead loads. Live loads result from items which are typically not a permanent part of the building structure, such as machinery, office equipment, people, snow, and the like.

Dead loads are due to the weight of the building structure, partitions, and permanent equipment. Bolts have also been used to connect two concrete elements together; however, these bolts have been arranged to transfer primarily shear loads from one concrete element to another rather than to transfer primarily tension loads between concrete elements. Even though the use of precast concrete elements reduces the amount of time and labor required to frame a building, the current methods of providing connections between precast concrete elements still is unnecessarily labor intensive and requires a substantial amount of time to implement.

When buildings are erected in seismic zones, i.e. those geographical zones in which earthquakes occur, the connections between the concrete elements of a building experience additional loading due to vibrations produced by earthquakes. The earthquake effects on a building are generally represented as horizontal forces. A common rule used in the construction of a building is that the building frame should resist such horizontal forces equal to approximately one-tenth of the dead load supported by the building frame. In some cases, the building frame is designed to resist such horizontal forces equal to approximately one-tenth of the dead load plus a portion of the live load supported by the building frame. Even though improvements have been made in the techniques used to construct buildings so that they can better withstand earthquakes, such construction techniques still do not ensure that buildings can adequately withstand the forces exerted on them by earthquakes.

SUMMARY OF THE INVENTION

The present invention reduces the time and labor necessary to connect precast concrete elements together during the framing of a building. Furthermore, the method of connecting concrete elements, whether such elements are precast or cast in place, during the construction of buildings according to the present invention allows significant earthquake energy to be dissipated into the connecting system of the building, thereby preventing any significant damage to the building structure in the presence of even severe earthquakes.

Accordingly, in one aspect of the present invention, a subassembly is provided for use in erecting a building. The subassembly includes first and second precast concrete elements. The first precast concrete element has a connecting member. The connecting member of the first precast concrete element has a hole extending therethrough. The second precast concrete element also has a connecting member. The connecting member of the second precast concrete element has a threaded hole. The subassembly also includes a bolt which is inserted through the hole of the connecting member of the first precast concrete element and is threadably secured into the threaded hole of the connecting member of the second precast concrete element so as to attach the first and second precast concrete elements together. The bolt and the first and second precast concrete elements are arranged to transfer primarily tension loads between the first and second precast concrete elements, although shear loads are transferred as well.

In another aspect of the present invention, a connector plate includes a body, a first means for attaching the body to a reinforcing bar embedded in a first precast concrete element, and a second means for attaching the body to a connecting member of a second precast concrete element.

In yet another aspect of the present invention, a rod includes a body, a first means for attaching the body to a shear plate embedded in a first precast concrete element, and a second means for attaching the body to a connecting member of a second precast concrete element.

In a further aspect of the present invention, a subassembly is provided for use in erecting a building and for dissipating earthquake energy so as to prevent significant structural damage to the building in the presence of an earthquake. The subassembly includes first and second concrete elements and a connecting means for connecting the first and second concrete elements together. The connecting means includes a ductile member embedded in the first concrete element. The ductile member is arranged to yield so as to dissipate earthquake energy in order to prevent significant structural damage to the building in the presence of an earthquake.

In a still further aspect of the present invention, a concrete element which is useful in the erection of a building includes a body of concrete and a connecting means for connecting the body of concrete to other concrete elements and for dissipating earthquake energy into the body of concrete to thereby prevent significant structural damage to a building due to an earthquake. The connecting means is embedded in the body of concrete.

In a further aspect of the present invention, a concrete element which is useful in the erection of a building includes a concrete body. The concrete body has a recess of sufficient size to permit torquing of a bolt. A reinforcing bar is embedded in the concrete body. A connecting member is in the recess of the concrete body and is threadably attached to the reinforcing bar. The connecting member has a hole therethrough. The hole in the connecting member is arranged to receive a bolt.

In another aspect of the present invention, a concrete element which is useful in the erection of a building includes a concrete body and a shear plate embedded in the concrete body. The shear plate has a threaded hole. A ductile rod is embedded in the concrete body, and has first and second ends and a longitudinal axis extending between the first and second ends. The ductile rod has a threaded hole which is threaded into the first end of the ductile rod along the longitudinal axis. The second end of the ductile rod is threaded. The threaded second end of the ductile rod is threaded into the threaded hole of the shear plate.

In another aspect of the present invention, a rod for interconnecting concrete elements comprises a ductile body, and first and second connecting means. The first connecting means is at a first end of the ductile body and is arranged to connect two concrete elements to one another. The second connecting means is at a second end of the ductile body and is arranged to connect the ductile body to a member.

BRIEF DESCRIPTION OF THE DRAWING

These and other features and advantages of the present invention will become more apparent from a detailed consideration of the invention when taken in conjunction with the drawing in which:

FIG. 3 illustrates a frontal elevation of a connector plate which may be used as a connecting member in order to connect two concrete elements together according to the present invention;

FIG. 4 is a cross-sectional view taken along section line 4—4 through the connector plate illustrated in FIG. 3;

FIG. 5 is a cross-sectional view taken along section line 5—5 through the connector plate illustrated in FIG. 3;

FIG. 6 illustrates a tie bar which may be used in the present invention;

FIG. 8 illustrates a frontal elevation of a shear plate for use in conjunction with the ductile rod illustrated FIG. 7;

FIG. 9 illustrates a side view of the shear plate illustrated in FIG. 8;

FIG. 10 shows a partial assembly of the connection system according to the present invention without the presence of concrete;

FIG. 11 shows an assembly template which is useful in maintaining the relative position of certain of the members shown in FIG. 10 during casting of a concrete element; and, FIG. 12 illustrates another embodiment of a ductile rod according to the present invention.

DETAILED DESCRIPTION

Figure 1:
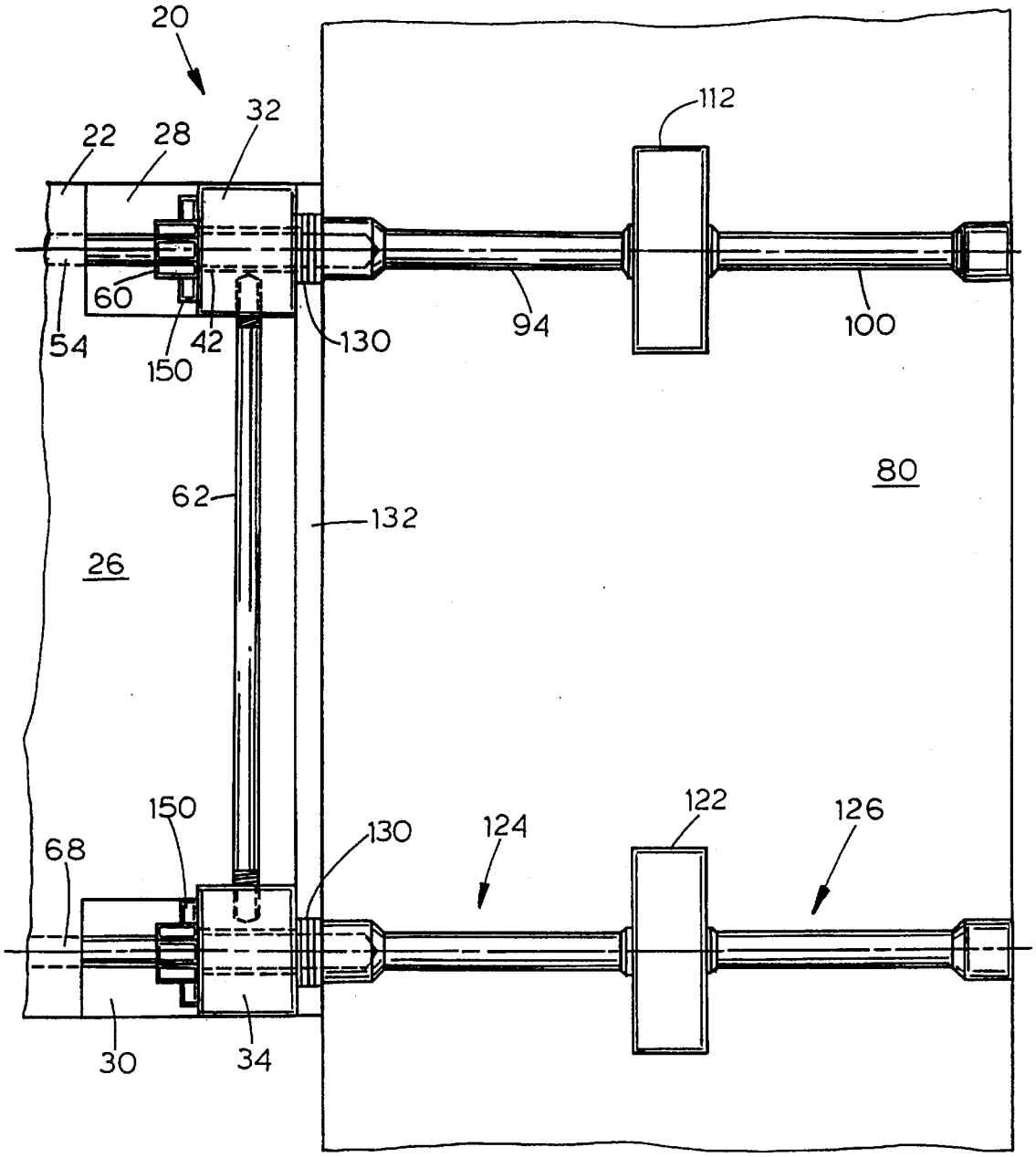
FIG. 1 is a side view illustrating a concrete element subassembly according to the present invention.
Figure 2:
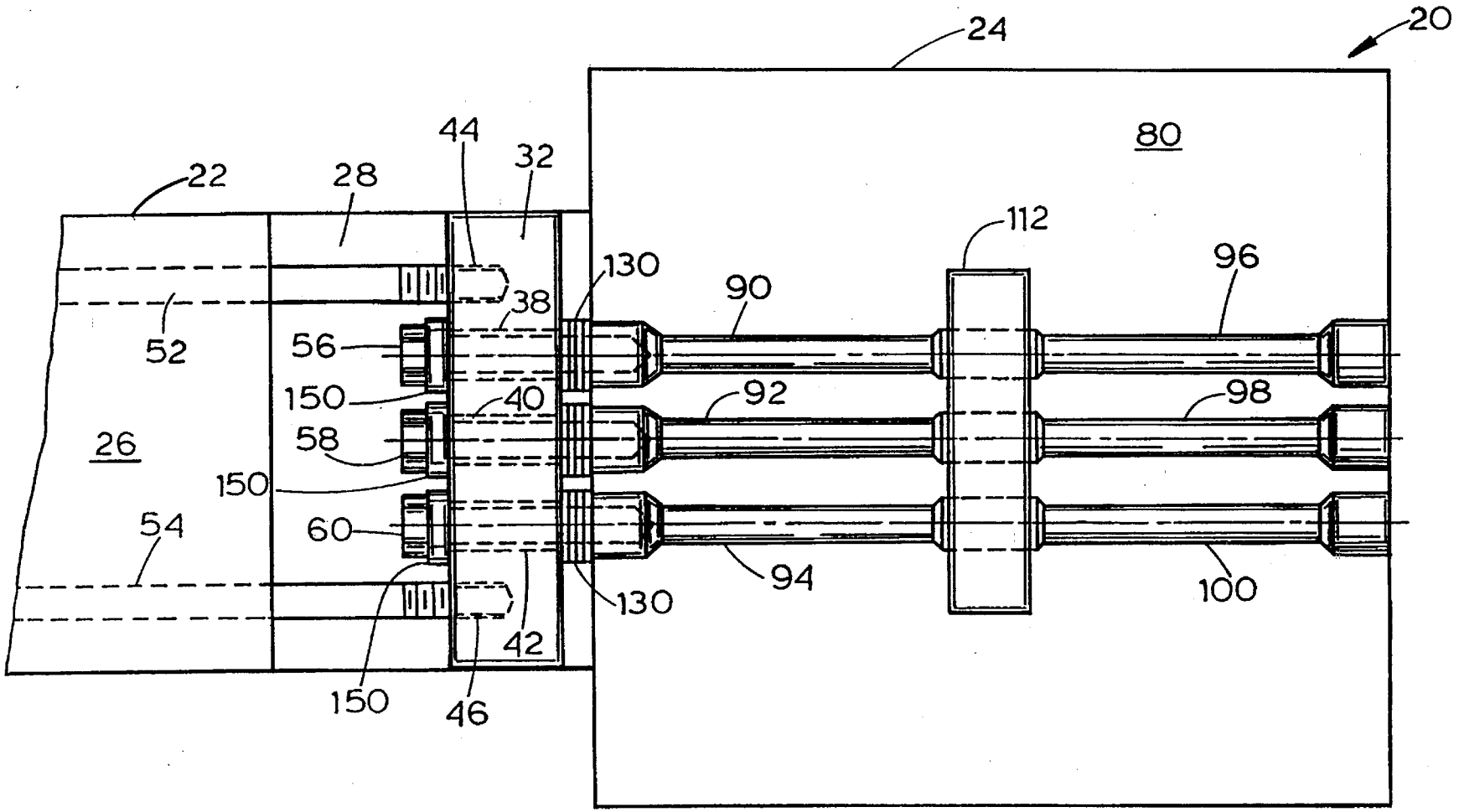
FIG. 2 is a top view of the subassembly illustrated in FIG. 1.

As shown in FIGS. 1 and 2, a subassembly 20, which is useful in the erection of buildings, includes a precast concrete element 22 and a precast concrete element 24. For example, the precast concrete element 22 may be in the form of a precast concrete beam, and the precast concrete element 24 may be in the form of a precast concrete column. The precast concrete element 22 includes a body of concrete 26 having a pair of recesses 28 and 30 which accommodate corresponding connecting members 32 and 34.

A representative one of the connecting members 32 and 34, such as the connecting member 32, is shown in more detail in FIGS. 3–5. The connecting member 32, as illustrated, is in the form of a connector plate and includes a body 36. The connecting member 32 has three holes 38, 40, and 42, all of which extend entirely through the body of the connecting member 32. These holes, as will be described hereinafter, receive bolts for attaching the precast concrete element 22 to the precast concrete element 24.

The connecting member 32 also has a pair of holes 44 and 46, both of which may be threaded and both of which may extend entirely through the body 36 of the connecting member 32. Finally, the connecting member 32 has a pair of holes 48 and 50, both of which may be threaded into, but not through, the body 36. The hole 48 may be provided, for example, with left hand threads, and the hole 50 may be provided, for example, with right hand threads.

The body 36 of the connecting member 32, for example, is comprised of a ductile steel alloy having a composition in accordance with ASTM standard A441, or with ASTM standard A572, grades 42 or 50, or with ASTM standard A588, grades 42, 46 or 50, or with any other suitable composition. Also, one example of the dimensions, in inches, for the connecting member 32 shown in FIGS. 3, 4, and 5 is as follows:

| | |
|---|---|
| A | 16.0 |
| B | 5.0 |
| C | 4.0 |
| D | 2.5 |
| E | 1.5 |
| F | 3.0 |
| G | 3.75 |
| H | 1.75 |

-continued

| | |
|---|---|
| I | 1.25 |
| J | 0.875 |
| K | 8.5 |
| L | 2.0 |

As shown in FIG. 2, the threaded hole 44 of the connecting member 32 threadably receives a threaded end of a first reinforcing bar 52, and the threaded hole 46 in the connecting member 32 threadably receives the threaded end of a second reinforcing bar 54. Most of the length of the reinforcing bars 52 and 54, except the ends which are threaded into corresponding connecting members, are embedded in the body of concrete 26. Bolts 56, 58, and 60 are inserted through the corresponding holes 38, 40, and 42 in the connecting member 32 and are used to attach the precast concrete element 22 to the precast concrete element 24 and to transfer primarily tension loads between the precast concrete elements 22 and 24, although shear loads are transferred as well.

As shown in FIG. 1, a tie rod 62, the majority of which is embedded in the body of concrete 26 of the precast concrete member 22, may be threaded at each end and may be threadably attached to the connecting members 32 and 34. Thus, the tie bar 62 is threaded into one of the holes 48 and 50 of the connecting member 32, and is threaded into a corresponding hole in the other connecting member 34. A similar tie rod (not shown in the drawing) is threaded into the other one of the holes 48 and 50 of the connecting member 32, and is threaded into a corresponding hole in the other connecting member 34.

The tie rod 62 is shown in FIG. 6. This tie rod 62 may be a hot rolled round bar fabricated of any suitable material such as, for example, a material meeting ASTM standard A36. It has a pair of threaded ends 64 and 66. If desired, the threaded end 64 may be provided with right hand threads, and the threaded end 66 may be provided with left hand threads, in order to facilitate threadable attachment of the tie rod 62 to the connecting members 32 and 34. One example of the dimensions, in inches, for the tie rod 62 shown in FIG. 6 is as follows:

| | |
|---|---|
| A | 24.0 |
| B | 1.5 |
| C | 0.875 |

Furthermore, a pair of reinforcing bars, only one of which, i.e. a reinforcing bar 68, is shown in the drawing (FIG. 1), is attached to the connecting member 34. This pair of reinforcing bars may be similar to the reinforcing bars 52 and 54 and is threaded into threaded holes of the connecting member 34 corresponding to the threaded holes 44 and 46 of the connecting member 32.

Prior to casting of the precast concrete member 22, a suitable form is constructed having the desired shape. The form may be conventional except that it must provide the recesses 28 and 30 and must support therein the connecting member 32 with its reinforcing bars 52 and 54 threadably attached thereto, the connecting member 34 with its reinforcing bars (only the reinforcing bar 68 is shown in the drawing) threadably attached thereto, and the tie rods attached to the connecting members 32 and 34 (only the tie rod 62 is shown in the drawing). Conventional reinforcing bars and stirrups (which have not been shown for the purpose of clarity) may also be suitably supported within the form, as is well known. Then, concrete is poured into the form in order to complete the fabrication of the precast concrete element 22. After this concrete sets, the precast concrete element 22 is ready for connection to a second precast concrete element such as the precast concrete element 24. For example, if the precast concrete element 22 is a beam, it is now ready for connection to a precast concrete column.

The reinforcing bars 52, 54, and 68, and the tie rods 62, are embedded in the body of concrete 26 of the precast concrete element 22 as shown. The bolts 56, 58, and 60 may be inserted through their corresponding holes 38, 40, and 42 in the connecting member 32 either before casting of the precast concrete element 32, or afterward, depending upon the size of the recess 28. Likewise, a similar set of bolts may be inserted through their corresponding holes in the connecting member 34 either before casting of the precast concrete element 22, or afterward, depending upon the size of the recess 30. Furthermore, although the connecting members 32 and 34 are shown as residing exclusively in the corresponding recesses 28 and 30, a portion of the connecting members 32 and 34 may be embedded in the body of concrete 26 as long as there is sufficient clearance for a torque wrench to apply torque to the bolts of the connecting members.

Figure 7:
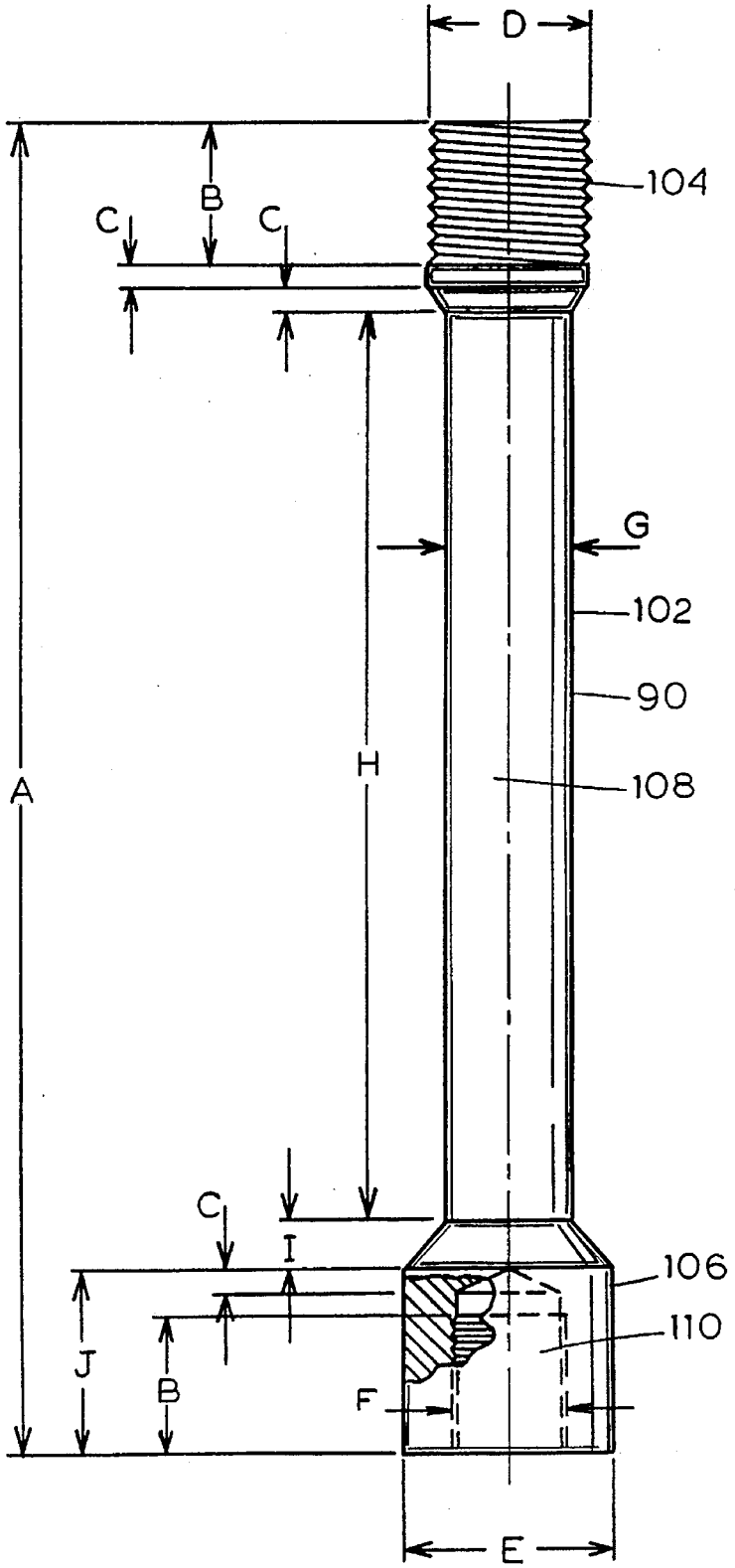
FIG. 7 illustrates a ductile rod which may be used as a connecting member in order to connect two concrete elements together according to the present invention.

The precast concrete element 24 has a body of concrete 80 and a plurality of connecting members. These connecting members are shown as ductile rods 90, 92, 94, 96, 98, and 100. Although the ductile rods 90, 92, 94, 96, 98, and 100 are shown with solid lines for clarity, it should be understood that these ductile rods are embedded in the body of concrete 80. Each of these ductile rods may be similar in construction so that an example of only one such ductile rod, i.e. the ductile rod 90, is shown in detail in FIG. 7. The ductile rod 90 has a body 102, and the body 102 has ends 104 and 106, and a longitudinal axis 108 extending through the body 102 and between the ends 104 and 106. The end 104 is externally threaded, and the end 106 is provided with an internally threaded hole 110 which is threaded along the longitudinal axis 108. The body 102 of the ductile rod 90 may be comprised of a ductile steel alloy having a composition in accordance with ASTM standard A441, or with ASTM standard A572, grades 42 or 50, or with ASTM standard A588, grades 42, 46 or 50, or with any other suitable composition which permits the ductile rod to yield sufficiently so that significant earthquake energy is dissipated. Accordingly, in the presence of an earthquake, the ductile rod 90 can yield in elongation on the order of one to two percent of its overall length. One example of the dimensions, in inches, for the ductile rod 90 shown in FIG. 7 is as follows:

| | |
|---|---|
| A | 14.0 |
| B | 1.5 |
| C | 0.25 |
| D | 1.75 |
| E | 2.25 |
| F | 1.25 |
| G | 1.375 |
| H | 9.5 |
| I | 0.5 |
| J | 2.0 |

As shown in FIGS. 1 and 2, the externally threaded ends of the ductile rods 90, 92, 94, 96, 98, and 100, such as the externally threaded end 104 (see FIG. 7) of the ductile rod 90, are threadably attached to a shear plate 112. The shear plate 112 is shown in more detail in FIGS. 8 and 9. The shear plate 112 has a body 114. Three holes 116, 118, and 120 are provided through the body 114 and are internally threaded. The body 114 of the shear plate 112 may be fabricated from any suitable material such as any suitable steel plate. One example of the dimensions, in inches, for the shear plate 112 shown in FIGS. 8 and 9 is as follows:

| | |
|---|---|
| A | 12.0 |
| B | 8.0 |
| C | 3.0 |
| D | 4.0 |
| E | 6.0 |
| F | 1.75 |

As shown in FIG. 2, the threaded holes 116, 118, and 120 of the shear plate 112 threadably receive the threaded ends 104 of the corresponding ductile rods 90, 92, and 94 so that the ductile rods 90, 92, and 94 are located on one side of the shear plate 112. Similarly, the threaded holes 116, 118, and 120 of the shear plate 112 threadably receive the threaded ends 104 of the corresponding ductile rods 96, 98, and 100 so that the ductile rods 96, 98, and 100 are located on the other side of the shear plate 112.

As shown in FIG. 1, the precast concrete element 24 has a second shear plate 122 embedded therein to which a first set of ductile rods 124, similar to the ductile rods 90, 92, and 94, are threadably attached on a first side thereof and to which a second set of ductile rods 126, similar to the ductile rods 96, 98, and 100, are threadably attached on a second side thereof. Although the shear plates 112 and 122 and the first and second sets of ductile rods 124 and 126 are shown with solid lines for clarity, it should be understood that these shear plates and ductile rods are embedded in the body of concrete 80.

Prior to casting of the precast concrete member 24, a suitable form is constructed having the desired shape. The form may be conventional except that it must support therein the ductile rods 90, 92, 94, 96, 98, and 100, and the first and second sets of ductile rods 124 and 126, all of which are threadably attached to the corresponding shear plates 112 and 122 prior to casting. Conventional reinforcing bars and stirrups (which have not been shown for the purpose of clarity) may also be suitably supported within the form, as is well known. Then, concrete is poured into the form in order to complete the fabrication of the precast concrete element 24. After the concrete sets, the precast concrete element 24 is ready for connection to a second precast concrete element such as concrete element 22. For example, if the precast concrete element 24 is a column, it is now ready for connection to a precast concrete beam.

When the precast concrete elements 22 and 24 are to be attached to one another at a construction site of a building, the precast concrete elements 22 and 24 are made to abut one another so that the bolt 56 may be torqued in order to thread it into the threaded hole 110 in the end 106 of the ductile rod 90. Similarly, the bolts 58 and 60 are torqued to thread them into the threaded holes 110 of the corresponding ductile rods 92 and 94. Also, the bolts of the connecting member 34 are torqued to thread them into the threaded ends 110 of the corresponding ductile rods of the first set of ductile rods 124. If desired, a plurality of shim plates 130 may be provided between the precast concrete element 22 and the precast concrete element 24 for each of the bolts 56, 58, and 60 of the connecting member 32 and for each of the bolts of the connecting member 34. When each of the bolts has received a predetermined amount of torque, which may be indicated by a torque wrench, an area 132 between the precast concrete elements 22 and 24 may be filled with a suitable grout. Also, the recesses 28 and 30 may be similarly filled with grout.

A second precast concrete element, similar to the precast concrete element 22, can also be attached to the precast concrete element 24 by use of the ductile rods 96, 98, 100, and the second set of ductile rods 126. If the precast concrete element 24 is set along an outside wall of the building under construction, the ductile rods 96, 98, 100, and the second set of ductile rods 126 are unnecessary and need not be included in the precast concrete element 24. Furthermore, if the precast concrete element 24 is set at a corner of a building under construction, the ductile rods 96, 98, 100 may be attached to a shear plate at right angles to the ductile rods 90, 92, and 94, and the set of ductile rods 126 may be attached to a shear plate at right angles to the set of ductile rods 124. If so, suitable shear plates may be provided into which each of the ductile rods can be threaded.

In the presence of an earthquake, the ductile nature of the ductile rods allows the ductile rods to yield either in tension or in compression and allows the energy produced by the earthquake to be dissipated through the yielding of these ductile rods. Although the ductile rods may yield, a building constructed with the connecting members of the present invention will maintain its integrity and will not suffer significant structural damage due to the earthquake. Also, any shear forces which are exerted at the interface between the precast concrete elements 22 and 24 are transferred by friction through the connected members of the present invention. Accordingly, there is no significant slip between the precast concrete elements 22 and 24 at the design levels of earthquake displacements.

FIG. 10, which shows the connecting system according to the present invention, is a view similar to the view of FIG. 1, but without the concrete. FIG. 10 also shows an assembly template 140 and bolts 142 and 144 which may be used to temporarily hold the ductile rods 96, 98, 100, and the second set of ductile rods 126 in position while the precast concrete element 24 is poured. The assembly template 140 is also shown in FIG. 11. Steel washers 150 (FIGS. 1 and 2) may be provided, as desired, between the bolts and the connecting members 32 and 34. Also, the bolts of the connecting members 32 and 34, for example, may be comprised of a steel alloy having a composition in accordance with ASTM standard A490 or may be comprised of any other suitable material.

Figure 12:
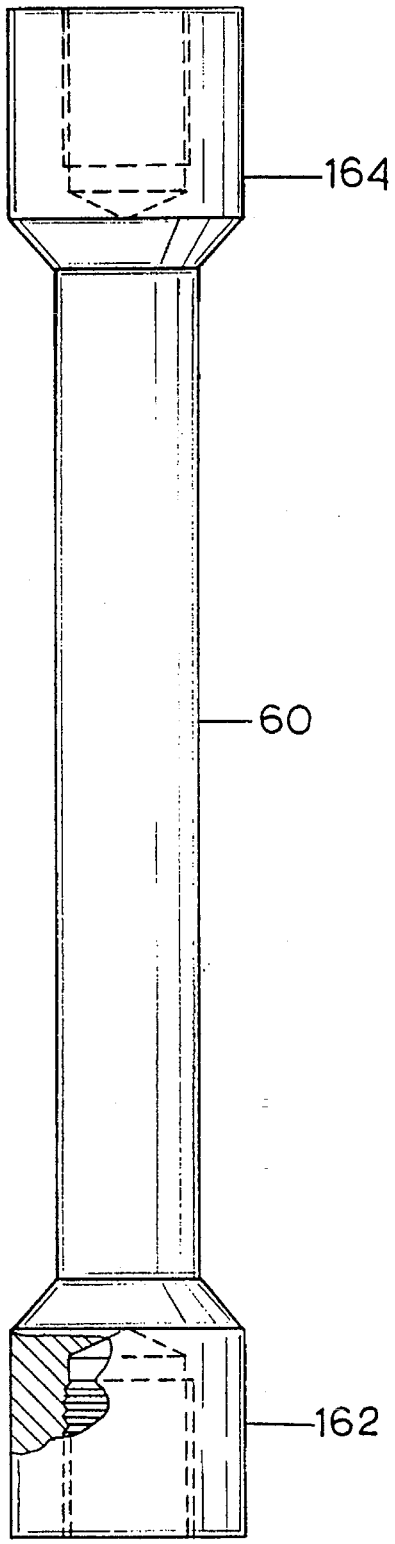

Another embodiment of a ductile rod is shown in FIG. 12. As shown in FIG. 12, a ductile rod 160 has first and second internally threaded ends 162 and 164, respectively. Each of the internally threaded ends 162 and 164 may be threaded similarly to the threaded end 106 of the ductile rod 90 shown in FIG. 7.

The ductile rod 160 may be used in cast-in-place concrete elements as a splice to interconnect two high strength reinforcing bars, one of which may be threaded into the threaded end 162 of the ductile rod 160 and the other of which may be threaded into the threaded end 164 of the ductile rod 160. Thus, because the ductile rod 160 is ductile, it is arranged to yield in order to dissipate earthquake energy.

The ductile rod 160 may also be used at the base of a concrete shear wall to connect the shear wall to a concrete foundation. Moreover, the ductile rod 160 may be used to join concrete frame elements together, and/or to connect a concrete column to a concrete foundation. The ductile rod 160, thus, eliminates the need to overlap reinforcing bars and allows the use of high strength reinforcing bars as flexural reinforcing bars in ductile concrete systems.

It should be apparent that the present invention may be used also for concrete elements which are cast in place. It should also be apparent that only the ductile rods need be fabricated from a ductile material in order to dissipate earthquake energy without significant structural damage to a building. Moreover, the dimensions given above for the connecting members, for the tie rods, for the ductile rods, and for the shear plates are for a specific application and amount of earthquake energy to be dissipated; different applications and amounts of earthquake energy to be dissipated may require different dimensions. These and other modifications of the present invention have been described herein. Further modifications of the present invention will occur to those skilled in the art. Accordingly, the present invention is to be limited only by the appended claims.

We claim:

1. A subassembly for use in erecting a building, the subassembly comprising:

a first precast concrete element having a connecting member, the connecting member of the first precast concrete element including a hole extending therethrough;

a second precast concrete element having a ductile connecting member, the ductile connecting member of the second precast concrete element including a threaded hole; and, a bolt inserted through the hole of the connecting member of the first concrete element and being threadably secured into the threaded hole of the ductile connecting member of the second precast concrete element so as to attach the first precast concrete element and the second precast concrete element together, wherein the bolt and the first and second precast concrete elements are arranged to transfer primarily tension loads between the first and second precast concrete elements so as to dissipate earthquake energy, although shear loads are transferred as well.

2. The subassembly of claim 1 wherein the hole of the connecting member of the first precast concrete member is a first hole of the connecting member of the first precast concrete member, wherein the connecting member of the first precast concrete member has a second hole therein, wherein the second hole of the connecting member of the first precast concrete member is threaded, and wherein the first precast concrete element has a reinforcing rod which is embedded in the first precast concrete member and which is threaded into the second hole of the connecting member of the first precast concrete member.

3. The subassembly of claim 1 wherein the connecting member of the first precast concrete element is a first connecting member of the first precast concrete element, wherein the ductile connecting member of the second precast concrete element is a first ductile connecting member of the second precast concrete element, wherein the bolt is a first bolt, wherein the first precast concrete element has a second connecting member, wherein the second connecting member of the first precast concrete element has a hole extending therethrough, wherein the second precast concrete element has a second ductile connecting member, wherein the second ductile connecting member of the second precast concrete element has a threaded hole, and wherein a second bolt is inserted through the hole of the second connecting member of the first concrete element and is threadably secured into the threaded hole of the second ductile connecting member of the second precast concrete element.

4. The subassembly of claim 3 wherein the hole of the first connecting member of the first precast concrete member is a first hole of the first connecting member of the first precast concrete member, wherein the first connecting member of the first precast concrete member has a second hole therein, wherein the second hole of the first connecting member of the first precast concrete member is threaded, wherein the first precast concrete element has a first reinforcing rod which is embedded in the first precast concrete member and which is threaded into the second hole of the first connecting member of the first precast concrete member, wherein the hole of the second connecting member of the first precast concrete member is a first hole of the second connecting member of the first precast concrete member, wherein the second connecting member of the first precast concrete member has a second hole therein, wherein the second hole of the second connecting member of the first precast concrete member is threaded, wherein the first precast concrete element has a second reinforcing rod which is embedded in the first precast concrete member and which is threaded into the second hole of the second connecting member of the first precast concrete member.

5. The subassembly of claim 4 wherein the first connecting member of the first precast concrete member has a third hole therein, wherein the third hole of the first connecting member of the first precast concrete member is threaded, wherein the second connecting member of the first precast concrete member has a third hole therein, wherein the third hole of the second connecting member of the first precast concrete member is threaded, and wherein the first precast concrete element has a third reinforcing rod which is embedded in the first precast concrete member and which is threaded into the third holes of the first and second connecting members of the first precast concrete member.

6. A subassembly for use in erecting a building, the subassembly comprising:

a first precast concrete element having a connecting member, the connecting member of the first precast concrete element including a hole extending therethrough;

a second precast concrete element having a ductile rod embedded therein, wherein the ductile rod has first and second ends and a longitudinal axis extending between the first and second ends of the ductile rod, and wherein a threaded hole is threaded into the first end of the ductile rod along the longitudinal axis; and, a bolt inserted through the hole of the connecting member of the first concrete element and being threadably secured into the threaded hole of the ductile rod so as to attach the first precast concrete element and the second precast concrete element together, wherein the bolt and the first and second precast concrete elements are arranged to transfer primarily tension loads between the first and second precast concrete elements so as to dissipate earthquake energy, although shear loads are transferred as well.

7. The subassembly of claim 6 wherein the second precast concrete element further has a shear plate embedded therein, wherein the shear plate has a threaded hole, wherein the second end of the rod is threaded, and wherein the second end of the rod is threaded into the threaded hole of the shear plate.

8. The subassembly of claim 7 wherein the rod is fabricated of a ductile material.

9. The subassembly of claim 6 wherein the connecting member of the first precast concrete element is a first connecting member of the first precast concrete element, wherein the rod is a first rod, wherein the bolt is a first bolt, wherein the first precast concrete element has a second connecting member, wherein the second connecting member of the first precast concrete element has a hole extending therethrough, wherein the second precast concrete element has a second rod embedded in the second precast concrete element, wherein the second rod has first and second ends and a longitudinal axis extending between the first and second ends of the second rod, wherein a threaded hole is threaded into the first end of the second rod along its longitudinal axis, and wherein a second bolt is inserted through the hole of the second connecting member of the first precast concrete element and is threaded into the threaded hole in the first end of the second rod.

10. The subassembly of claim 9 wherein the second precast concrete element has first and second shear plates precast therein, wherein the first and second shear plates have corresponding threaded holes, wherein the second ends of the first and second rods are threaded, wherein the second end of the first rod is threaded into the threaded hole of the first shear plate, and wherein the second end of the second rod is threaded into the threaded hole of the second shear plate.

11. The subassembly of claim 10 wherein the first and second rods are fabricated of a ductile material.

12. The subassembly of claim 11 wherein the first and second connecting members of the first precast concrete element are fabricated of a ductile material.

13. The subassembly of claim 6 wherein the connecting member of the first precast concrete element comprises a connector plate having a body, wherein the connector plate comprises means for attaching the body to a reinforcing bar embedded in the first precast concrete element, and wherein the body of the connector plate further comprises the hole through which the bolt is inserted for threaded engagement with the ductile rod.

14. The subassembly of claim 13 wherein the means comprises a threaded hole in the body, and wherein the threaded hole is arranged to receive a threaded end of the reinforcing bar.

15. A concrete element comprising:

a concrete body;

a shear plate embedded in the concrete body wherein the shear plate has a threaded hole; and, a rod embedded in the concrete body, wherein the rod has first and second ends and a longitudinal axis extending between the first and second ends of the rod, wherein the rod has a threaded hole which is threaded into the first end of the rod along the longitudinal axis, wherein the second end of the rod is threaded, wherein the second end of the rod is threaded into the threaded hole of the shear plate, and wherein the rod is ductile so as to dissipate earthquake energy.

16. The concrete element of claim 15 wherein the concrete body comprises a precast concrete body which is precast around the rod and shear plate.

17. The concrete element of claim 15 wherein the rod is a first ductile rod, wherein the shear plate is a first shear plate, wherein the concrete element further comprises a second shear plate embedded in the concrete body, wherein the second shear plate has a threaded hole, wherein the concrete element further comprises a second ductile rod embedded in the concrete body, wherein the second ductile rod has first and second ends and a longitudinal axis extending between the first and second ends of the second ductile rod, wherein the second ductile rod has a threaded hole which is threaded into the first end of the second ductile rod along the longitudinal axis thereof, wherein the second end of the second ductile rod is threaded, and wherein the second end of the second ductile rod is threaded into the threaded hole of the second shear plate.

18. The concrete element of claim 17 wherein the concrete body comprises a precast concrete body which is precast around the first and second ductile rods and the first and second shear plates.

19. A subassembly for use in erecting a building, the subassembly comprising:

a first concrete element having a connecting member, the connecting member of the first concrete element including a hole extending therethrough;

a second concrete element having a ductile rod embedded therein, wherein the ductile rod has first and second ends and a longitudinal axis extending between the first and second ends of the ductile rod, and wherein a threaded hole is threaded into the first end of the ductile rod along the longitudinal axis; and, a bolt inserted through the hole of the connecting member of the first concrete element and being threadably secured into the threaded hole of the ductile rod so as to attach the first concrete element and the second concrete element together, wherein the bolt and the first and second concrete elements are arranged to transfer primarily tension loads between the first and second concrete elements so as to dissipate earthquake energy, although shear loads are transferred as well.

20. The subassembly of claim 19 wherein the connecting member of the first concrete element comprises a connector plate having a body, wherein the connector plate comprises means for attaching the body to a reinforcing bar embedded in the first concrete element, and wherein the body of the connector plate further comprises the hole through which the bolt is inserted for threaded engagement with the ductile rod.

21. The subassembly of claim 20 wherein the means comprises a threaded hole in the body, and wherein the threaded hole is arranged to receive a threaded end of the reinforcing bar.

22. The subassembly of claim 19 wherein the second concrete element has a shear plate embedded therein, wherein the shear plate has a threaded hole, wherein the second end of the rod is threaded, and wherein the second end of the rod is threaded into the threaded hole of the shear plate.

23. The subassembly of claim 22 wherein the rod is fabricated of a ductile material.

24. The subassembly of claim 19 wherein the connecting member of the first concrete element is a first connecting member of the first concrete element, wherein the rod is a first rod, wherein the bolt is a first bolt, wherein the first concrete element has a second connecting member, wherein the second connecting member of the first concrete element has a hole extending therethrough, wherein the second concrete element has a second rod embedded in the second concrete element, wherein the second rod has first and second ends and a longitudinal axis extending between the first and second ends of the second rod, wherein a threaded hole is threaded into the first end of the second rod along its longitudinal axis, and wherein a second bolt is inserted through the hole of the second connecting member of the first concrete element and is threaded into the threaded hole in the first end of the second rod.

25. The subassembly of claim 24 wherein the second concrete element has first and second shear plates therein, wherein the first and second shear plates have corresponding threaded holes, wherein the second ends of the first and second rods are threaded, wherein the second end of the first rod is threaded into the threaded hole of the first shear plate, and wherein the second end of the second rod is threaded into the threaded hole of the second shear plate.

26. The subassembly of claim 25 wherein the first and second rods are fabricated of a ductile material.

27. The subassembly of claim 26 wherein the first and second connecting members of the first concrete element are fabricated of a ductile material.

28. A subassembly for use in erecting a building, the subassembly comprising:

a first concrete element having a connecting member, the connecting member of the first concrete element including a hole extending therethrough;

a second concrete element having a ductile connecting member, the ductile connecting member of the second concrete element including a threaded hole; and, a bolt inserted through the hole of the connecting member of the first concrete element and being threadably secured into the threaded hole of the ductile connecting member of the second concrete element so as to attach the first concrete element and the second concrete element together, wherein the bolt and the first and second concrete elements are arranged to transfer primarily tension loads between the first and second concrete elements so as to dissipate earthquake energy, although shear loads are transferred as well.

29. The subassembly of claim 28 wherein the hole of the connecting member of the first concrete member is a first hole of the connecting member of the first concrete member, wherein the connecting member of the first concrete member has a second hole therein, wherein the second hole of the connecting member of the first concrete member is threaded, and wherein the first concrete element has a reinforcing rod which is embedded in the first concrete member and which is threaded into the second hole of the connecting member of the first concrete member.

30. The subassembly of claim 28 wherein the connecting member of the first concrete element is a first connecting member of the first concrete element, wherein the ductile connecting member of the second concrete element is a first ductile connecting member of the second concrete element, wherein the bolt is a first bolt, wherein the first concrete element has a second connecting member, wherein the second connecting member of the first concrete element has a hole extending therethrough, wherein the second concrete element has a second ductile connecting member, wherein the second ductile connecting member of the second concrete element has a threaded hole, and wherein a second bolt is inserted through the hole of the second connecting member of the first concrete element and is threadably secured into the threaded hole of the second ductile connecting member of the second concrete element.

31. The subassembly of claim 30 wherein the hole of the first connecting member of the first concrete member is a first hole of the first connecting member of the first concrete member, wherein the first connecting member of the first concrete member has a second hole therein, wherein the second hole of the first connecting member of the first concrete member is threaded, wherein the first concrete element has a first reinforcing rod which is embedded in the first concrete member and which is threaded into the second hole of the first connecting member of the first concrete member, wherein the hole of the second connecting member of the first concrete member is a first hole of the second connecting member of the first concrete member, wherein the second connecting member of the first concrete member has a second hole therein, wherein the second hole of the second connecting member of the first concrete member is threaded, wherein the first concrete element has a second reinforcing rod which is embedded in the first concrete member and which is threaded into the second hole of the second connecting member of the first concrete member.

32. The subassembly of claim 31 wherein the first connecting member of the first concrete member has a third hole therein, wherein the third hole of the first connecting member of the first concrete member is threaded, wherein the second connecting member of the first concrete member has a third hole therein, wherein the third hole of the second connecting member of the first concrete member is threaded, and wherein the first concrete element has a third reinforcing rod which is embedded in the first concrete member and which is threaded into the third holes of the first and second connecting members of the first concrete member.

* * * * *